US009526291B2

(12) United States Patent
Beauchamp et al.

(10) Patent No.: US 9,526,291 B2
(45) Date of Patent: Dec. 27, 2016

(54) HELMET WITH REAR ADJUSTMENT MECHANISM

(71) Applicant: Sport Maska Inc., Montreal (CA)

(72) Inventors: Pierre-Luc Beauchamp, St-Hippolyte (CA); Philippe Martin, Chambly (CA); Simon Bergeron, Montreal (CA)

(73) Assignee: SPORT MASKA INC., Montreal, Quebec ( * ) Notice: Subject to any disclaimer, the term of this patent is extended or adjusted under 35 U.S.C. 154(b) by 201 days.

(21) Appl. No.: 13/930,557

(22) Filed: Jun. 28, 2013

(65) Prior Publication Data

US 2015/0000015 A1 Jan. 1, 2015

(51) Int. Cl.
*A42B 1/22* (2006.01)
*A42B 3/32* (2006.01)

(52) U.S. Cl.
CPC ..... *A42B 3/324* (2013.01)

(58) Field of Classification Search
CPC ..... A42B 3/32; A42B 3/145; A42B 3/324
USPC ..... 2/418, 420, 425, 417, 419
See application file for complete search history.

(56) References Cited

U.S. PATENT DOCUMENTS

| | | | | |
|---|---|---|---|---|
| 4,477,929 | A | 10/1984 | Mattsson | |
| 4,539,715 | A | 9/1985 | Clement | |
| 5,956,776 | A | 9/1999 | Chartrand | |
| 6,108,824 | A | 8/2000 | Fournier et al. | |
| 6,324,700 | B1 | 12/2001 | McDougall | |
| 6,385,780 | B1 | 5/2002 | Racine | |
| 6,966,075 | B2 | 11/2005 | Racine | |
| 8,056,150 | B2 | 11/2011 | Stokes et al. | |
| 8,095,995 | B2 | 1/2012 | Alexander et al. | |
| 8,156,574 | B2 | 4/2012 | Stokes et al. | |
| 8,448,266 | B2 | 5/2013 | Alexander et al. | |
| 2004/0172739 | A1* | 9/2004 | Racine | A42B 3/324 2/417 |
| 2007/0266481 | A1* | 11/2007 | Alexander et al. | 2/414 |
| 2010/0050323 | A1* | 3/2010 | Durocher et al. | 2/414 |
| 2013/0025032 | A1 | 1/2013 | Durocher et al. | |
| 2013/0025033 | A1 | 1/2013 | Durocher et al. | |

* cited by examiner

*Primary Examiner* — Clinton T Ostrup
*Assistant Examiner* — Abby Spatz
(74) *Attorney, Agent, or Firm* — Norton Rose Fulbright Canada

(57) ABSTRACT

A protective helmet with a second shell having a top end connected to a top portion of a first shell such as to allow relative movement between the first shell and the bottom end of the second shell about a connection between the top end and the top portion along two opposed directions. Two connecting members are each connected to a respective side portion of the first shell at a fixed location and are each connected to the bottom end of the second shell through a respective connection allowing relative movement therebetween. An adjustment mechanism is connected to the second shell and has a movable portion movable between an unlocked position free of the connecting members to allow relative movement between the first and second shells and a locked position in engagement with the connecting members to prevent relative movement between the first and second shells along at least one of the opposed directions.

19 Claims, 6 Drawing Sheets

HELMET WITH REAR ADJUSTMENT MECHANISM

TECHNICAL FIELD

The application relates generally to protective helmets and, more particularly, to adjustable protective helmets.

BACKGROUND OF THE ART

Helmets for various activities, including sporting activities and work in dangerous environments, often require a shell or protective surface. The range of shapes and sizes of a wearer's head may require a helmet to be made larger or smaller to fit. Furthermore, adjustment may be required depending on the activity, environmental conditions, appearance, or some other factor. In particular, the wearer of a helmet may want to have a tighter or looser fit, depending on circumstances, or may alternatively want to modify the fit, for example during play, or depending on the season, etc.

Adjustable helmets typically include two sections that are moved to change the length of the helmet. Usually, the two sections are slidingly engaged along their sides and an adjustment mechanism is provided on each side to selectively block the relative sliding motion. Other types of helmets require the use of tools to adjust the relative position of the helmet sections.

SUMMARY

In one aspect, there is provided a protective helmet comprising: a first shell including a front portion configured to cover a front of a head of a wearer, a top portion extending from a top of the front portion and configured to cover a top of the head, and two side portions extending rearwardly from the front portion and downwardly from the top portion and configured to each cover a respective side of the head; a second shell configured to cover a rear of the head, the second shell having a top end connected to the top portion of the first shell and an opposed bottom end extending between the two side portions and movable with respect thereto about the connection between the top end and the top portion along two opposed directions; two connecting members, each connecting member connected to a respective one of the side portions at a fixed location and connected to the bottom end of the second shell through a respective connection allowing relative movement therebetween; and an adjustment mechanism connected to the second shell and having a movable portion thereof movable between a unlocked position free of the connecting members to allow relative movement between the first and second shells and a locked position in engagement with the connecting members to prevent relative movement between the first and second shells along at least one of the opposed directions.

In another aspect, there is provided a protective helmet comprising: a first shell configured to cover a major part of a head of a wearer, the first shell including two side portions spaced apart by an elongated opening defined through the first shell and configured to extend over a rear of the head; an elongated second shell configured to cover a rear of the head, the second shell having a top end connected to the first shell and an opposed bottom end, the second shell extending within and across the elongated opening of the first shell, the bottom end of the second shell being movable relative to the second shell along two opposed directions; an adjustment mechanism connected to the second shell and having a movable portion pivotable with respect to an outer surface of the second shell between a locked position adjacent the second shell and an unlocked position away from the second shell; and two connecting members connected to the bottom end of the second shell such as to allow relative movement therebetween, each connecting member having a first end connected to a respective one of the side portions of the first shell and an opposed second end engaged to the adjustment mechanism when the movable portion is in the locked position such as prevent relative movement therebetween along at least one of the two opposed directions, the movable portion in the unlocked position being disengaged from the connecting members.

DESCRIPTION OF THE DRAWINGS

Reference is now made to the accompanying figures in which.

DETAILED DESCRIPTION

Figure 1:
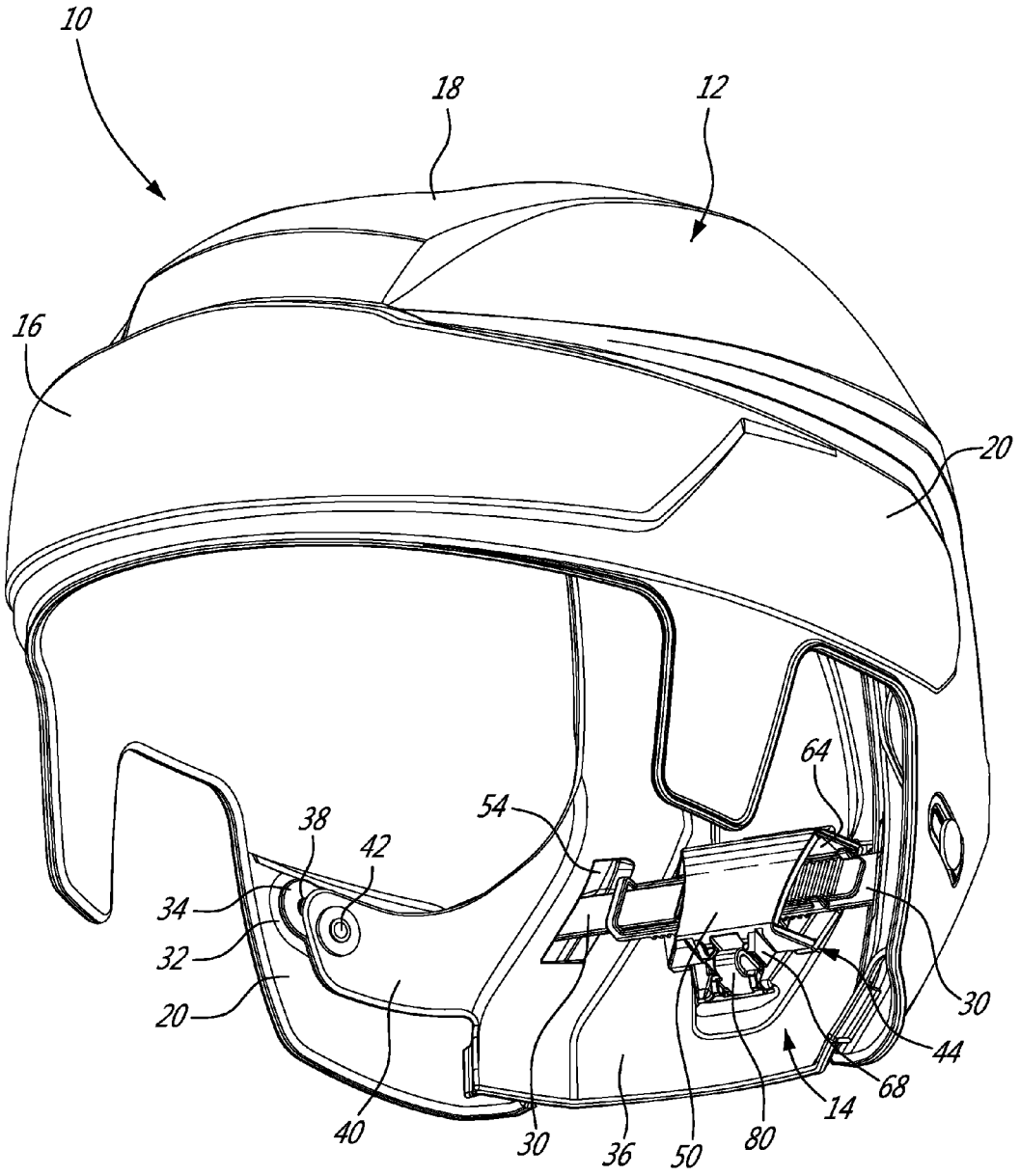
FIG. 1 is a schematic front tridimensional view of a protective helmet in accordance with a particular embodiment.

Referring now to the drawings, a protective helmet is generally shown at 10. Although a particular helmet configuration is shown, it is understood that the helmet can alternately be any other type of protecting helmet. In a particular embodiment, the helmet 10 is a hockey helmet. Other possible types of helmet include, but are not limited to, a lacrosse helmet, a baseball helmet and a football helmet.

Figure 3:
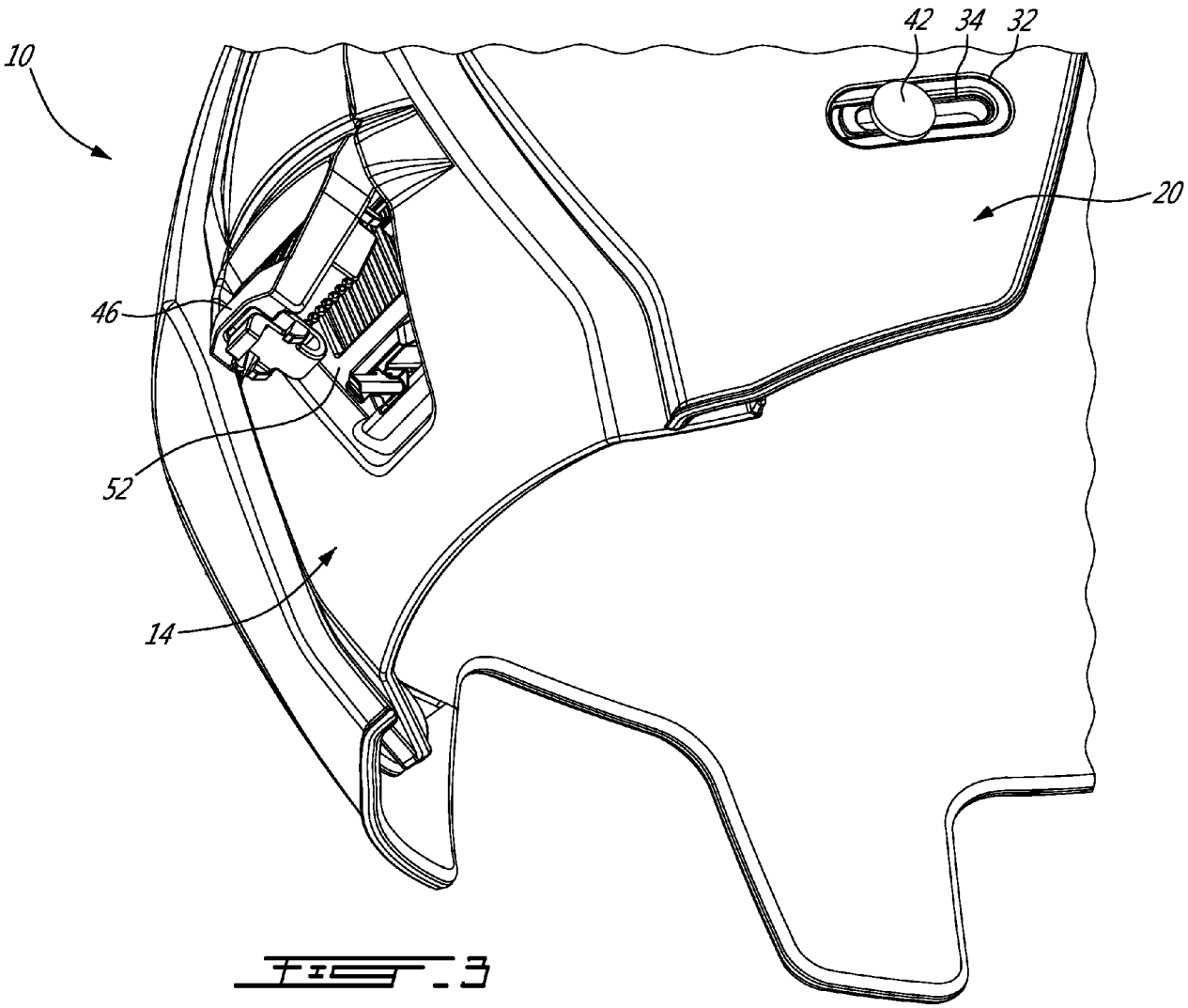
FIG. 3 is a schematic partial rear tridimensional of the helmet of FIG. 1, showing an adjustment mechanism thereof in an unlocked position.

Referring to FIGS. 1 and 3, the helmet includes a first or front shell 12 and a second or rear shell 14 which are movably engaged to one another to allow a size of the helmet 10 to be adjusted. The first shell 12 includes a front portion 16 configured to cover the front of the head, including for example part of the forehead. Although not shown, the front portion 16 may also extend downwardly to cover part of the face, and include for example eye protection, such as a clear window or mesh grid.

The first shell 12 also includes a top portion 18 extending from the top of the front portion 16 and configured to cover the top of the head. In the embodiment shown, the top portion 18 extends over only a front part of the top of the head. It is understood that in other configurations, the top portion 18 may be differently sized and/or configured. For example, the top portion 18 may be defined as part of the front portion 16 without being distinct therefrom.

The first shell 12 further includes two side portions 20 extending rearwardly from a respective side of the front portion 16 and downwardly from the top portion 18, configured to each cover a respective side of the head. In the embodiment shown, each side portion 20 is configured to extend downwardly in front and behind the ear while leaving the ear uncovered. It is understood that in other configurations, the side portions 20 may be differently sized and/or configured; for example, the side portions 20 may cover the ears.

In the embodiment shown, the first shell 12 is substantially "U-shaped" such that an elongated opening 22 (see FIG. 2) is defined downwardly from the top portion 18 between the two side portions 20.

The second shell 14 is configured to cover the rear of the head, and extends within and across the elongated opening 22 such as to cooperate with the first shell 12 to cover the head. In the embodiment shown, the second shell 14 extends inwardly of the first shell 12, with the first shell 12 partly overlapping it. Alternately, the second shell 14 may extend outwardly of the first shell 12 and partially overlap it.

Figure 2:
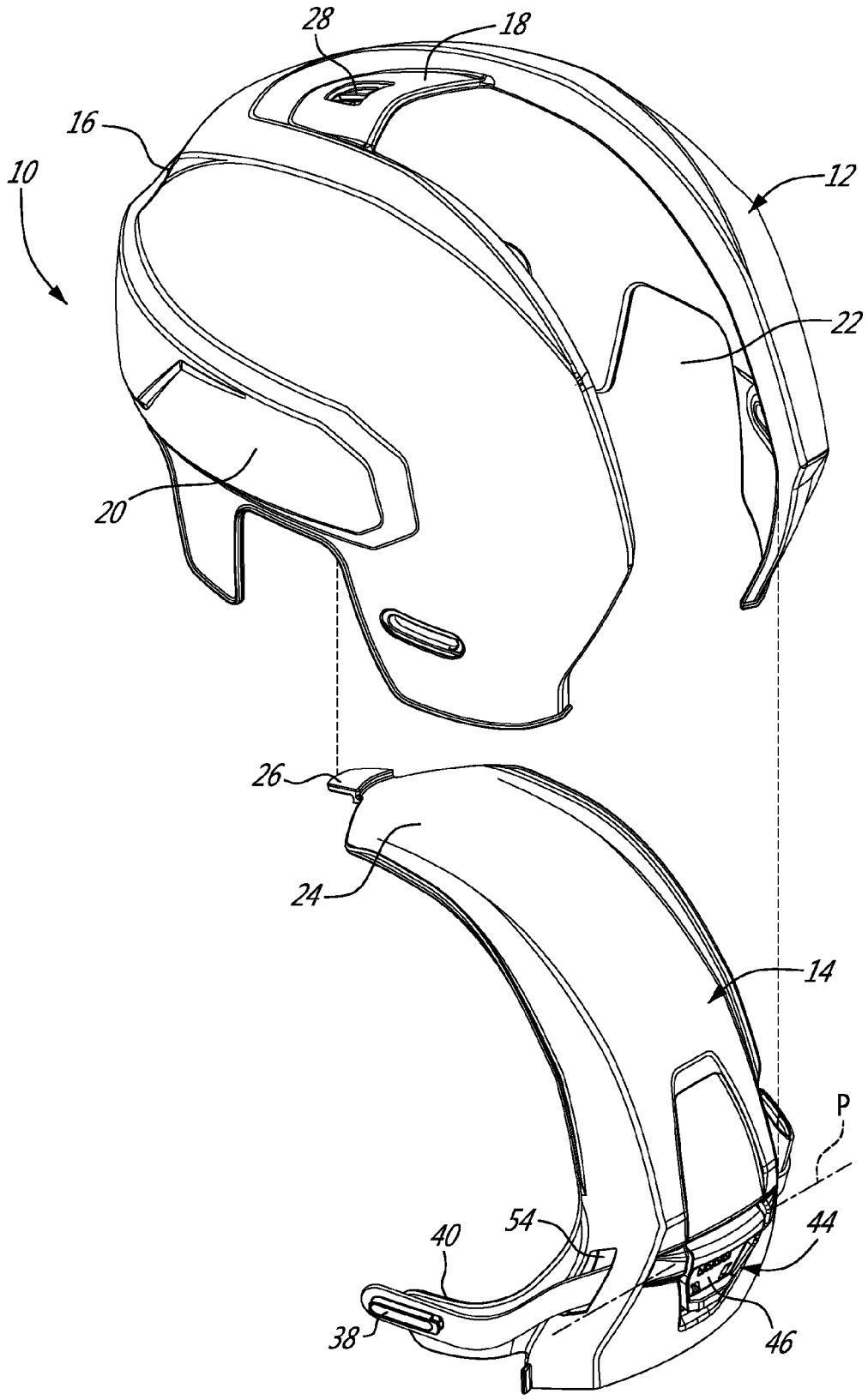
FIG. 2 is a schematic exploded rear tridimensional view of the helmet of FIG. 1, showing an adjustment mechanism thereof in a locked position.
Figure 4:
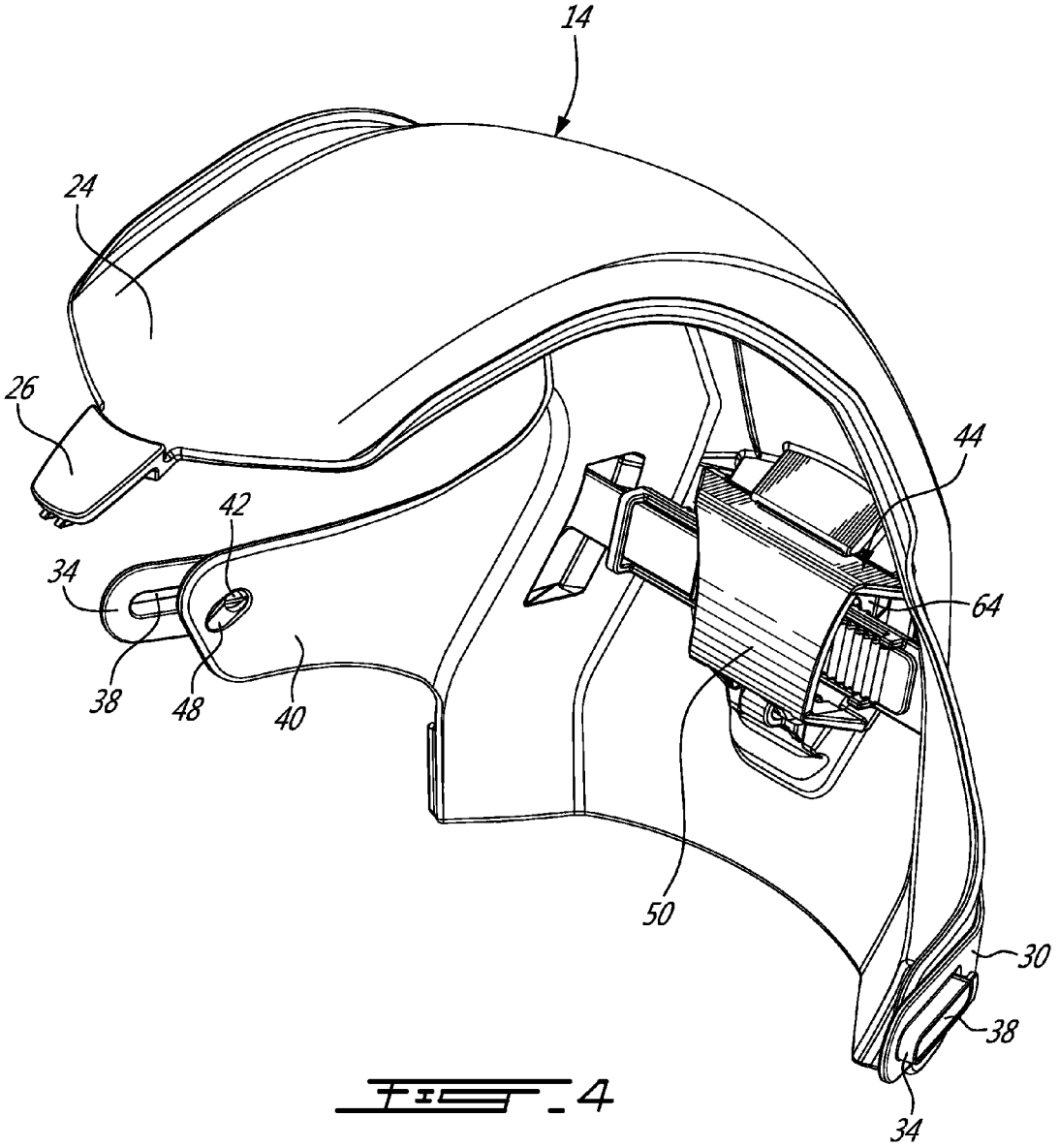
FIG. 4 is a schematic front tridimensional view of a shell of the helmet of FIG. 1.

Referring to FIGS. 2 and 4, the second shell 14 has a top end 24 including a forwardly projecting finger 26 complementary to a slot 28 (FIG. 2) of the top portion 18 to together define a retaining member. The second shell 14 is thus engaged to the top portion 18 of the first shell 12 through engagement of the finger 26 in the slot 28. In the embodiment shown, the engagement of the finger 26 in the slot 28 defines a fixed connection, and the material and thickness of the shells 12, 14 is selected such to provide sufficient flexibility to allow relative movement between the bottom edges of the first and second shells 12, 14 about their top connection, as will be further detailed below. Other types of connections may alternately be defined. For example, when more rigid materials are used, the connection between the top of the first and second shells 12, 14 may be a movable connection, such as for example a pivotable connection.

The first and second shells 12, 14 can be made of any type of adequate material, including but not limited to fiber reinforced materials, thermoplastics, and a combination thereof. In a particular embodiment, the first and second shells 12, 14 are made of high density polyethylene (HDPE).

Referring back to FIG. 1, the helmet 10 further includes two connecting members 30. Each connecting member 30 is connected to a respective one of the side portions 20 at a fixed location with respect thereto. In the particular embodiment shown, each side portion had a slot 32 defined therethrough. Each connecting member 30 includes an elongated engagement member 34 at one end which has a shape complementary to that of the slot 32, and which is snuggly received therein to engage the connecting member 30 to the side portion 18.

Each connecting member 30 is also connected to the bottom end 36 of the second shell 14 through a respective connection allowing relative movement therebetween. In the embodiment shown, each elongated engagement member 34 of each connected member 30 has an elongated slot 38 defined therethrough (see also FIG. 2), which also extends through the side portion 20. The bottom end 36 of the second shell 14 includes two arms 40 each extending toward a respective one of the side portions 20. Each arm 40 is engaged with a respective fastener 42, for example a pin, screw or rivet, which is snugly and slidingly received in the slot 38 of the respective engagement member 34. Thus, a relative sliding motion is defined along the length of the slot 38 between the bottom end 36 of the second shell 14 and the connecting members 30. The fastener 42 is received in a fixed position in a round hole 48 defined through the arm 40. The fastener 42 includes suitable features to prevent its disengagement from the slot 38 and hole 48, such as for example opposed enlarged heads having a respective diameter greater than that of the hole 48 and that a width of the slot 38.

In an alternate embodiment, the fastener 42 may be received in a slot defined through the arm 40 and engaged in a fixed position through the connecting member 30. Other types of movable engagements between the second shell 14 and each connecting member 30 may alternately be used. For example, the arms 40 may be omitted.

In the embodiment shown, the connection between each connecting member 30 and the bottom end 36 of the second shell 14 is defined together with, or at the same location than, the connection between the connecting member 30 and the side portion 20, since the slot 38 of the connecting member 30 is located in the slot 32 of the side portion 20. Alternately, the connection between each connecting member 30 and the bottom end 36 of the second shell 14 may be defined at a different location than the connection between the connecting member 30 and the side portion 20.

Referring back to FIG. 2, the helmet 10 further includes an adjustment mechanism 44 which is connected to the second shell 14. The adjustment mechanism 44 includes a movable portion 46 movable between a locked position (FIG. 2) and an unlocked position (FIG. 3). With the movable portion 46 in the unlocked position, the adjustment mechanism 44 is free of the connecting members 30, thus allowing the relative movement between the shells 12, 14 about their top connection along two opposed directions (increasing and decreasing the internal size of the helmet 10), within the range of movement allowed by the sliding connection between the connecting members 30 and the bottom end 36 of the second shell 14. With the movable portion 46 in the locked position, the adjustment mechanism 44 is engaged to the connecting members 30 to prevent relative movement between the shells 12, 14 along at least one direction—for example, allowing the size to be decreased but preventing it from being increased. In the embodiment shown, when the movable portion 46 is in the locked position, the adjustment mechanism 44 is engaged to the connecting members 30 to prevent relative movement between the shells 12, 14 along the two directions, thus preventing variation of the size of the helmet 10.

In the particular embodiment shown, the movable portion 46 is pivotable about an axis P extending horizontally when the helmet 10 is worn and the wearer is in a standing, upright position. The movable portion 46 is attached to the outer surface of the second shell 14. The connecting members 30 extend in the helmet 10 through a respective opening 54 (see FIGS. 1-2) defined through the second shell 14, and the movable portion 46 engages the connecting members 30 through a corresponding opening 52 (see FIG. 3) defined through the second shell 14.

Alternately, the movable portion 46 may be pivotable about a different axis, or movable through a different type of movement than a pivoting movement, for example slidable between the locked and unlocked positions.

Figure 5:
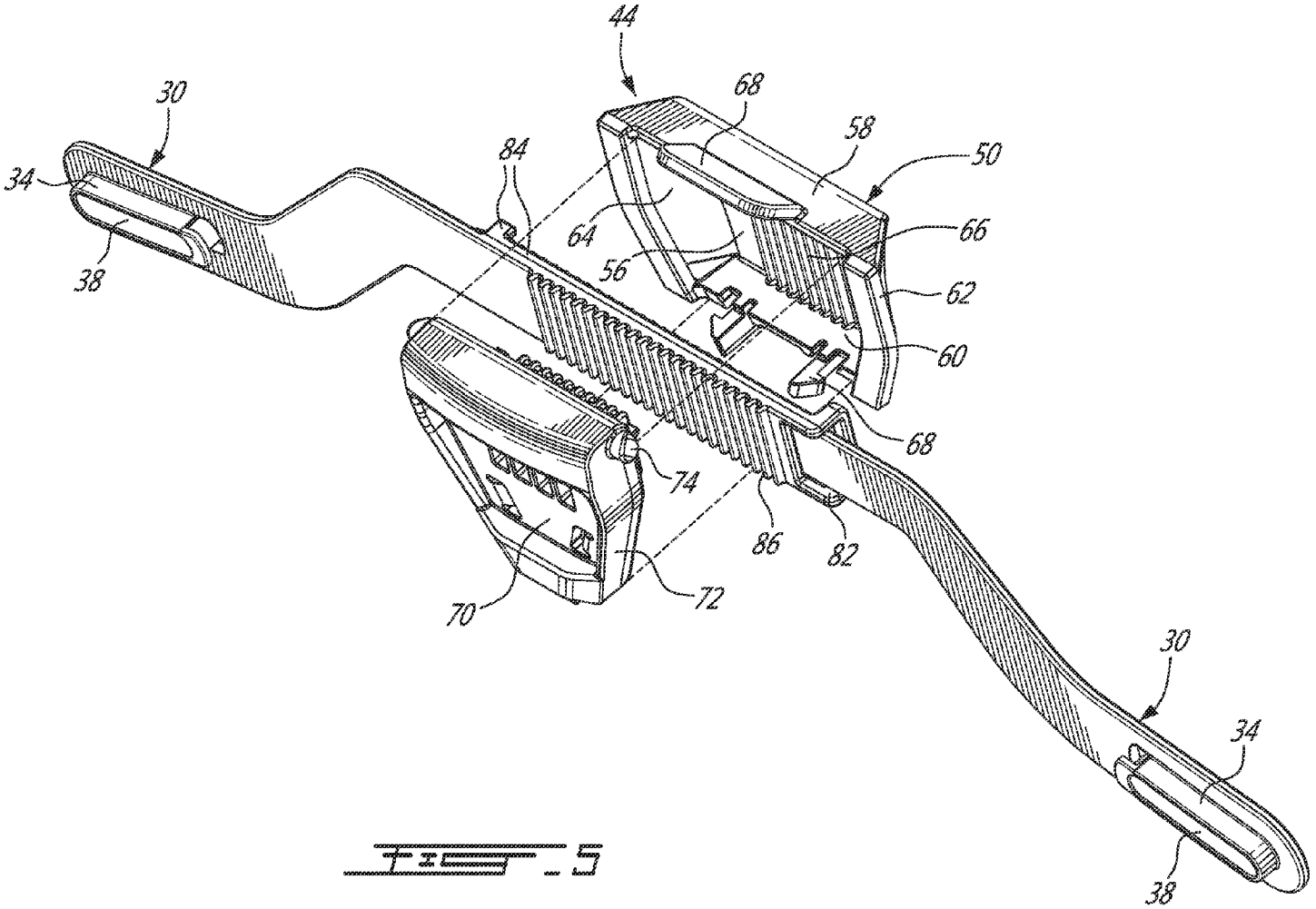
FIG. 5 is a schematic exploded rear tridimensional view of an adjustment mechanism and connecting members of the helmet of FIG. 1.
Figure 6:
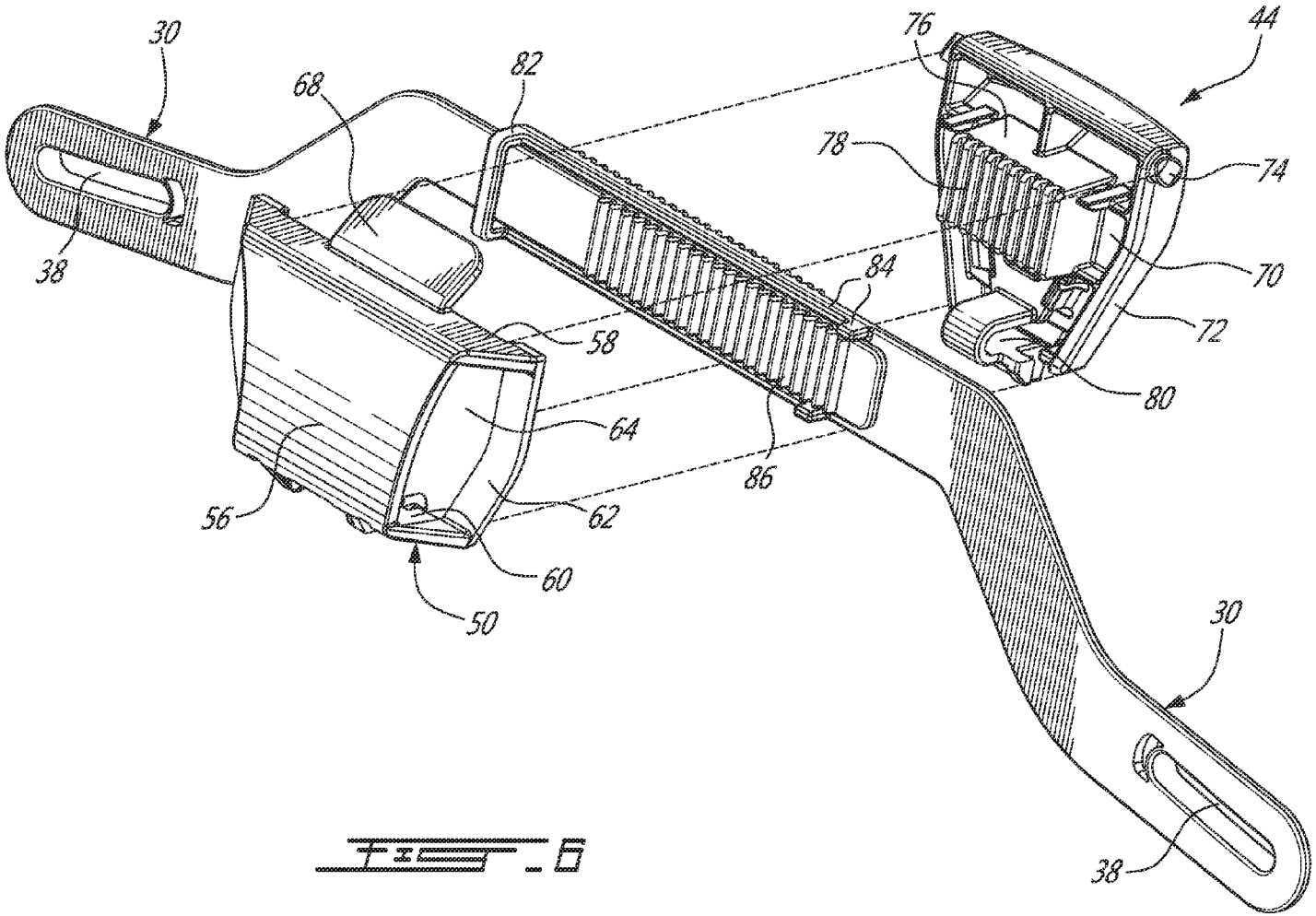
FIG. 6 is a schematic exploded front tridimensional view of the adjustment mechanism and connecting members of FIG. 5.

Referring to FIGS. 5-6, the engagement members 34 and adjustment mechanism 44 according to a particular embodiment are shown in more detail. The adjustment mechanism 44 includes a fixed portion 50 (also visible in FIGS. 1 and 4) having an inner wall 56 from which a top wall 58 and a bottom wall 60 extend. Side members 62 interconnect the top and bottom walls 58, 60 spaced apart from the inner wall 56, such as to define two opposed open sides 64 through which the engagement members 34 extend (see FIGS. 1 and 4). The inner surface of the inner wall 56 has a series of teeth 66 defined therein. The top and bottom walls 58, 60 include engagement fingers 68 protruding therefrom and configured to be received in corresponding slots or other engagement features of the second shell 14, such that the fixed member 50 can be connected to the inner surface of the second shell 14 in a fixed position with respect thereto. Other types of attachment or connecting members may replace the fingers 68; for example, the fixed member 50 may be permanently connected to the second shell 14.

In the particular embodiment shown, the movable portion 46 is pivotally connected to the second shell 14 and the fixed member 50 is connected to the second shell 12 independently of the movable portion 46. In another embodiment, the movable portion 46 is pivotally connected to the fixed member 50, for example through the second shell 14.

The movable portion 46 includes an outer wall 70 and a perimeter wall 72 extending inwardly from the outer wall 70 around its perimeter. Two pins 74 extend from opposed sides of the perimeter wall 72, and are configured to engage corresponding slots or holes defined in the second shell 14. As can be seen from FIG. 3, the movable portion 46 is received in the opening 52 of the second shell 14 and engages the engagement member 34 through the opening 52 as will be defined further below.

The movable portion 46 includes a protuberance 76 (FIG. 6) extending inwardly from the outer wall 70 within the perimeter defined by the perimeter wall 72. The protuberance 76 has a series of teeth 78 defined therein.

The movable portion 46 also includes a retaining mechanism in the form of a retaining loop 80 extending inwardly from the outer wall 70 and spaced downwardly from the pins 74. The retaining loop 80 is detachably engageable in a corresponding opening of the second shell 14 when the movable portion 46 is in the locked position (see FIG. 1). The retaining loop 80 is compressible such as to be compressed by a user to disengage it from the second shell 14 to allow the movable portion 46 to be pivoted to the unlocked position. Alternately, the retaining loop 80 may be engaged to the fixed portion 50 and/or may have any other adequate configuration.

Still referring to FIGS. 5-6, in the particular embodiment shown, each connecting member 30 is in the form of a strap having the engagement member 34 and slot 38 at one end, with the opposed free ends of the connecting members 30 overlapping one another. One of the connecting member has a loop 82 defined at its free end to receive the other connecting member 30 therethrough, and one or more guiding members 84 extending on each side of the second connecting member 30, to retain the alignment of the overlapped connecting members 30. Each connecting member 30 has teeth 86 defined therein on its surface opposite the other connecting member 30, so as to respectively contact and engage the teeth 66, 78 of the fixed and movable portions 50, 46. Accordingly, in the locked position, the movable portion 46 presses both connecting members 30 against the fixed portion 50, and the complementary meshed teeth 86, 66 of one of the connecting members 30 and of the fixed portion 50 and the complementary meshed teeth 86, 78 of the other connecting member 30 and of the fixed portion 50 prevent the connecting members 30 from moving with respect to the second shell 14.

It is understood that the teeth 66, 78, 86 may be replaced by any other appropriate type of engagement features, including but not limited to teeth received in complementary holes, or meshing triangular teeth defining a ratchet mechanism allowing movement in one direction when the movable portion 46 is in the locked position. Alternately, if the compression force applied by the movable portion 46 against the fixed portion 50 is sufficient, the connecting members 50 may be free of engagement features and prevented from relative motion through frictional engagement caused by the compression force of the movable portion 46.

Although not shown, the contacting surfaces of the connecting members 30 may also include teeth or other engagement features so that the two connecting members 30 may be engaged to one another when pressed together by the movable portion 46 in the locked position, providing such engagement features may be disengaged when the movable portion 46 is in the unlocked position.

Accordingly, in use and in a particular embodiment, the user disengages the retaining loop 80 and pivots the movable member 46 in the unlocked position, away from the outer surface of the second shell 14. The user can thus move the second shell 14 relative to the first shell 12 to a desired position about their top connection, within the range allowed by the connecting members 30 interconnecting the bottom end 36 of the second shell 14 and the side portions 20 of the first shell 12. When the shells 12, 14 are in the desired relative position, the user pivots the movable portion 46 back to the locked position, engaging the retaining loop 80 to retain the movable portion 46 in place.

In a particular embodiment, the adjustment mechanism 44 allows for adjustment of the size of the helmet 10 using a single hand and/or while the helmet 10 is worn. The relatively low number of moving parts may reduce the risk of malfunction and/or render the adjustment mechanism 44 easy to use.

Although not shown, in a particular embodiment the first and second shells 12, 14 are each covered by a padding material which may be provided as one piece or in a plurality of complementary pieces and which may be in part movable with respect to the shells 12, 14. The fixed portion 50 and engagement members 34 extend between the second shell 14 and the padding layer covering it.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A protective helmet comprising:

a first shell including a front portion configured to cover a front of a head of a wearer, a top portion extending from a top of the front portion and configured to cover a top of the head, and two side portions extending rearwardly from the front portion and downwardly from the top portion and configured to each cover a respective side of the head;

a second shell configured to cover a rear of the head, the second shell having a top end connected to the top portion of the first shell and an opposed bottom end extending between the two side portions, the bottom end movable with respect to the two side portions about the connection between the top end and the top portion along two opposed directions;

two connecting members, each connecting member connected to a respective one of the side portions at a fixed location and connected to the bottom end of the second shell through a respective connection allowing relative movement therebetween; and an adjustment mechanism having a movable portion thereof movable between an unlocked position and a locked position, the adjustment mechanism remaining connected to the second shell in the unlocked and locked positions;

wherein with the movable portion in the unlocked position, the adjustment mechanism allows relative movement between the two connecting members and the second shell to allow relative movement between the first and second shells about the connection between the top end and the top portion; and wherein with the movable portion in the locked position, the adjustment mechanism contacts and engages the connecting members to prevent relative movement between the first and second shells along at least one of the opposed directions.

2. The helmet as defined in claim 1, wherein with the movable portion in the locked position, the adjustment mechanism contacts and engages the connecting members to prevent relative movement between the first and second shells along the two opposed directions.

3. The helmet as defined in claim 1, wherein the respective connection between each connecting member and the bottom end of the second shell is a sliding connection allowing relative sliding movement therebetween.

4. The helmet as defined in claim 1, wherein the respective connection between each connecting member and the bottom end of the second shell is defined by a fastener snugly and slidingly engaged in a slot defined through the connecting member or the bottom end.

5. The helmet as defined in claim 1, wherein the connection between each connecting member and the bottom end of the second shell is defined through the connection between the connecting member and the respective one of the side portions.

6. The helmet as defined in claim 5, wherein:

each connecting member includes an engagement member received through the respective one of the side portions at the fixed location, each engagement member having an elongated slot defined therethrough;

the bottom end includes two arms each extending toward a respective one of the side portions, with each of the two arms having a fastener protruding therefrom slidingly received in the slot of the engagement member engaged to the respective one of the side portions.

7. The helmet as defined in claim 1, wherein the movable portion of the adjustment mechanism includes a retaining mechanism detachably engageable to the second shell when the movable portion is in the locked position.

8. The helmet as defined in claim 1, wherein the movable portion is pivotable about an axis extending horizontally when the helmet is worn and the wearer is in a standing, upright position.

9. The helmet as defined in claim 1, wherein the first shell has a substantially U shape defining a rear elongated opening therethrough between the two side portions, the second shell being received in and extending across the elongated opening.

10. A protective helmet comprising:

a first shell including a front portion configured to cover a front of a head of a wearer, a top portion extending from a top of the front portion and configured to cover a top of the head, and two side portions extending rearwardly from the front portion and downwardly from the top portion and configured to each cover a respective side of the head;

a second shell configured to cover a rear of the head, the second shell having a top end connected to the top portion of the first shell and an opposed bottom end extending between the two side portions and movable with respect thereto about the connection between the top end and the top portion along two opposed directions;

two connecting members, each connecting member connected to a respective one of the side portions at a fixed location and connected to the bottom end of the second shell through a respective connection allowing relative movement therebetween; and an adjustment mechanism connected to the second shell and having a movable portion thereof movable between an unlocked position free of the connecting members to allow relative movement between the first and second shells and a locked position where the adjustment mechanism engages the connecting members to prevent relative movement between the first and second shells along at least one of the opposed directions;

wherein each connecting member is connected to the respective one of the side portions at a first end thereof and includes an opposed second end, the second ends of the connecting members overlapping one another and being received between a fixed portion of the adjustment mechanism having a fixed position relative to the second shell and the movable portion of the adjustment mechanism, and wherein with the movable portion in the locked position, the second end of one of the connecting members is engaged to the fixed portion and the second end of the other one of the connecting members is engaged to the movable portion.

11. The helmet as defined in claim 10, wherein the second end of the one of the connecting members and the fixed portion include complementary teeth in meshed engagement when the movable portion is in the locked position, and the second end of the other one of the connecting members and the movable portion include complementary teeth in meshed engagement when the movable portion is in the locked position.

12. A protective helmet comprising:

a first shell configured to cover a major part of a head of a wearer, the first shell including two side portions spaced apart by an elongated opening defined through the first shell and configured to extend over a rear of the head;

an elongated second shell configured to cover a rear of the head, the second shell having a top end connected to the first shell by a top connection and an opposed bottom end, the top connection being a flexible fixed connection or a pivotable connection, the second shell extending within and across the elongated opening of the first shell, the bottom end of the second shell being movable relative to the first shell along two opposed directions about the top connection between the top end and the first shell;

an adjustment mechanism having a movable portion pivotable with respect to an outer surface of the second shell between a locked position and an unlocked position, the adjustment mechanism remaining connected to the second shell in the unlocked and locked positions; and two connecting members connected to the bottom end of the second shell such as to allow relative movement between the connecting members and the second shell, each connecting member having a first end connected to a respective one of the side portions of the first shell and an opposed second end engaged to the adjustment mechanism when the movable portion is in the locked position such as to prevent relative movement between the first and second shells along at least one of the two opposed directions, the movable portion in the unlocked position being disengaged from the connecting members.

13. The helmet as defined in claim 12, wherein the second end of each connecting member is engaged to the adjustment mechanism when the movable portion is in the locked position such as to prevent relative movement therebetween along the two opposed directions.

14. The helmet as defined in claim 12, wherein the bottom end is connected to each of the connecting members through a respective sliding connection.

15. The helmet as defined in claim 12, wherein the movable portion of the adjustment mechanism includes a retaining mechanism detachably engageable to the second shell when the movable portion is in the locked position.

16. The helmet as defined in claim 12, wherein the movable portion is pivotally engaged to the second shell such as to be pivotable about an axis extending horizontally when the helmet is worn and the wearer is in a standing, upright position.

17. The helmet as defined in claim 12, wherein the adjustment mechanism includes a fixed portion opposite the movable portion, the movable portion in the locked position pressing the connecting members against the fixed portion.

18. The helmet as defined in claim 17, wherein with the movable portion in the locked position, the second end of one of the connecting members is engaged to the fixed portion through meshed complementary teeth and the second end of the other one of the connecting members is engaged to the movable portion through meshed complementary teeth.

19. The helmet as defined in claim 12, wherein:

each connecting member includes an engagement member received through the respective one of the side portions at a fixed location, each engagement member having an elongated slot defined therethrough;

the bottom end including two arms each extending toward a respective one of the side portions, each of the two arms having a fastener protruding therefrom slidingly received in the slot of the engagement member engaged to the respective one of the side portions.

* * * * *